US007670996B2

(12) United States Patent
Daniel et al.

(10) Patent No.: US 7,670,996 B2
(45) Date of Patent: Mar. 2, 2010

(54) LUBRICANT COMPOSITION HAVING A BASE OIL AND ONE OR MORE ADDITIVES, WHEREIN THE BASE OIL HAS BEEN OBTAINED FROM WAXY PARAFFINIC FISCHER-TROPSCH SYNTHESIZED HYDROCARBONS

(75) Inventors: Mervyn Frank Daniel, Katy, TX (US); Gilbert Robert Bernard Germaine, Petit Couronne (FR); David John Wedlock, Chester (GB)

(73) Assignee: Shell Oil Company, Houston, TX (US)

( * ) Notice: Subject to any disclaimer, the term of this patent is extended or adjusted under 35 U.S.C. 154(b) by 345 days.

(21) Appl. No.: 10/467,896

(22) PCT Filed: Feb. 8, 2002

(86) PCT No.: PCT/EP02/01352

§ 371 (c)(1), (2), (4) Date: Aug. 13, 2003

(87) PCT Pub. No.: WO02/064711

PCT Pub. Date: Aug. 22, 2002

(65) Prior Publication Data

US 2004/0077505 A1 Apr. 22, 2004

(30) Foreign Application Priority Data

Feb. 13, 2001 (EP) ..... 01301272
Mar. 5, 2001 (EP) ..... 01400562
Aug. 16, 2001 (EP) ..... 01402181

(51) Int. Cl.
*C10M 169/04* (2006.01)
*C10M 105/04* (2006.01)

(52) U.S. Cl. ..... 508/110; 208/18; 208/950

(58) Field of Classification Search ..... 508/110
See application file for complete search history.

(56) References Cited

U.S. PATENT DOCUMENTS

| | | | | |
|---|---|---|---|---|
| 14,184 | A | 2/1856 | Chapman | |
| 135,150 | A | 1/1873 | Pearce | |
| 2,603,589 | A | 7/1952 | Schaerer | 196/17 |
| 3,876,522 | A | 4/1975 | Campbell et al. | 208/58 |
| 3,965,018 | A | 6/1976 | Heilman et al. | |
| 4,299,714 | A | 11/1981 | Sugiura et al. | 252/73 |
| 4,343,692 | A | 8/1982 | Winquist | |
| 4,574,043 | A | 3/1986 | Chester et al. | |
| 4,582,616 | A | 4/1986 | Kita et al. | 252/17 |
| 4,859,311 | A | 8/1989 | Miller | |
| 4,919,788 | A | 4/1990 | Chen et al. | 208/59 |
| 4,943,672 | A | 7/1990 | Hamner et al. | |
| 4,983,273 | A | 1/1991 | Kennedy et al. | 208/89 |
| 5,053,373 | A | 10/1991 | Zones | |
| 5,059,299 | A | 10/1991 | Cody et al. | |
| 5,082,986 | A | 1/1992 | Miller | 585/667 |
| 5,135,638 | A | 8/1992 | Miller | 208/27 |
| 5,157,191 | A | 10/1992 | Bowes et al. | |
| 5,252,527 | A | 10/1993 | Zones | |
| 5,362,378 | A | 11/1994 | Borghard et al. | 208/138 |
| 5,370,818 | A | 12/1994 | Schleifstein | 252/186.25 |
| 5,372,703 | A | 12/1994 | Kamiya et al. | 208/58 |
| 5,447,621 | A | 9/1995 | Hunter | 208/58 |
| 5,456,820 | A | 10/1995 | Forbus, Jr. et al. | 208/111 |
| 5,693,598 | A | 12/1997 | Abraham et al. | |
| 5,723,716 | A | 3/1998 | Brandes et al. | 585/734 |
| 5,770,542 | A | 6/1998 | Brandes et al. | 502/527 |
| 5,785,862 | A | 7/1998 | Graham et al. | |
| 5,804,058 | A | 9/1998 | Grandvallet et al. | 208/171 |
| 5,856,365 | A | 1/1999 | Zennaro et al. | 518/715 |
| 5,935,417 | A | 8/1999 | Cody et al. | 208/87 |
| 6,059,955 | A | 5/2000 | Cody et al. | 208/18 |
| 6,060,437 | A | 5/2000 | Robson et al. | |
| 6,090,989 | A * | 7/2000 | Trewella et al. | 585/13 |
| 6,103,099 | A | 8/2000 | Wittenbrink et al. | 208/27 |
| 6,165,949 | A | 12/2000 | Berlowitz et al. | |
| 6,179,994 | B1 | 1/2001 | Clark et al. | 208/27 |
| 6,627,779 | B2 * | 9/2003 | O'Rear | 585/302 |
| 6,642,189 | B2 * | 11/2003 | Kurihara et al. | 508/364 |
| 2003/0119682 | A1 * | 6/2003 | Saini et al. | 508/167 |

(Continued)

FOREIGN PATENT DOCUMENTS

EP 113579 7/1984

(Continued)

OTHER PUBLICATIONS

Lewis, Sr., Richard J.; Hawley's Condensed Chemical Dictionary 14th Ed., John Wiley & Sons, New York, 2001 (p. 228).*

(Continued)

*Primary Examiner*—Vickey Nerangis

(57) ABSTRACT

A lubricant composition having a base oil and one or more additives wherein the lubricant composition has a kinematic viscosity at 100° C. of more than 5.6 cSt; a cold cranking simulated dynamic viscosity at −35° C. according to ASTM D 5293 of less than 6200 centiPoise (cP); and, a mini rotary viscosity test value of less than 60000 cP according to ASTM D 4684, wherein the base oil has been obtained from a waxy paraffinic Fischer-Tropsch synthesized hydrocarbon.

12 Claims, 1 Drawing Sheet

U.S. PATENT DOCUMENTS

| | | | | |
|---|---|---|---|---|
| 2004/0099571 | A1 | 5/2004 | Germaine et al. | 208/108 |
| 2004/0118744 | A1* | 6/2004 | Daniel et al. | 208/18 |
| 2004/0192979 | A1 | 9/2004 | Matthai et al. | 585/16 |

FOREIGN PATENT DOCUMENTS

| | | | |
|---|---|---|---|
| EP | 237655 | | 9/1987 |
| EP | 426223 | | 5/1991 |
| EP | 0471524 | | 2/1992 |
| EP | 323092 | | 4/1992 |
| EP | 0 532 118 | | 3/1993 |
| EP | 0 668 342 | | 8/1995 |
| EP | 0 666 894 | | 1/1997 |
| EP | 0 776 959 | | 3/1998 |
| EP | 0 832 171 | | 1/2000 |
| EP | 0994147 | A1 | 4/2000 |
| EP | 1102827 | | 9/2002 |
| EP | 1301272 | B1 | 4/2003 |
| EP | 1365005 | | 11/2003 |
| EP | 1389635 | | 2/2004 |
| EP | 1400562 | A2 | 3/2004 |
| EP | 1370633 | | 8/2005 |
| EP | 1366134 | | 11/2005 |
| FR | 0002364 | | 4/1963 |
| FR | 9905494 | | 11/2000 |
| GB | 713910 | | 8/1954 |
| JP | 01133988 | A | 5/1989 |
| JP | 2000345170 | | 1/2000 |
| WO | 95/23765 | | 9/1995 |
| WO | WO9603359 | | 2/1996 |
| WO | 97/18278 | | 5/1997 |
| WO | WO9721788 | | 6/1997 |
| WO | WO9802503 | | 1/1998 |
| WO | 99/20720 | | 4/1999 |
| WO | 99/34917 | | 7/1999 |
| WO | 00/14179 | | 3/2000 |
| WO | 00/14187 | | 3/2000 |
| WO | 00/14188 | | 3/2000 |
| WO | 00/15736 | | 3/2000 |
| WO | WO0014183 | | 3/2000 |
| WO | WO0014184 | | 3/2000 |
| WO | 00/29511 | | 5/2000 |
| WO | WO0107538 | | 2/2001 |
| WO | WO0174969 | | 2/2001 |
| WO | 01/18156 | | 3/2001 |
| WO | WO0157166 | | 8/2001 |
| WO | WO0164610 | A1 | 9/2001 |
| WO | WO0174969 | | 11/2001 |
| WO | WO03004875 | | 6/2002 |
| WO | WO02064710 | | 8/2002 |
| WO | WO02064711 | | 8/2002 |
| WO | WO02070627 | | 9/2002 |
| WO | WO02070629 | | 9/2002 |
| WO | WO02070630 | | 9/2002 |
| WO | WO02096842 | | 12/2002 |
| WO | WO03004875 | A1 | 1/2003 |

OTHER PUBLICATIONS

Safety Data Sheet for Shell Base Oils (CAS No. 92062-09-4), Aug. 31, 1996.*

Kirk-Othmer Encyclopedia of Chemical Technology. 3rd edition. vol. 14. pp. 477-526, (1981).

1999 Society of Automotive Engineerts. Inc. (SAE Intl J300) Surface Vehicle Standard. entitled"Engine Oil Viscosity Classification", issued Jun. 1911. Revised Dec. 1999.

Z. Liang & C. S. Hsu, "Molecular Speciation of Saturates by On-Line Liquid Chromatography-Field Ionization Mass Spectrometry". Energy & Fuels. 1998, 12. pp. 637-643.

Fisher-Tropsch Waxes (LeRoux. Oranje) Part I, pp. 9-32, 1984.

Dissertation of Glenda Webber. Sep. 2000. "Wax Characterisation by Instrumental Analysis", pp. 52-58.

M.M.G. Senden. "The Shell Middle Distillate Synthesis Process: Commercial plant experience and outlook into the future". Petrole et Techniques. Association Francaise Des Technic. Paris. Fr., No. 415, Jul. 1998. XP00)771962. pp. 94-97.

Sie. S. T. et al. "Conversion of Natural Gas to Transportation Fuels Via the Shell Middle Distillate Synthesis Process (SMDS)". Catalysis Today. vol. 8. 1991. pp. 371-394.

Avilino Sequeira. Jr.. Marchel Dekker Inc. "Lubricant Base Oil and Wax Processing". New York 1994. pp. 162-165.

Peter J.A. Tijm. Shell Intl Gas Ltd. Alternative Energy 1995. "The Markets for Shell Middle Distillate Synthesis Products". Vancouver. Canada. May 2-4, 1995.

Shell MDS (Malaysia) "Manufacturing Clean Products From Natural Gas". May 1995.

Extract from the website http://www.schu.ac.uk, providing a description of the gas chromatography technique, 2006.

Introduction to Organic Laboratory Techniques. D L Pavia et al. 1976. pp. 614-625.

Extract from web-site http.://www.deh.gov.au. providing a summary of the development of the European Union fuel standard through the years 1993 and 2000 (so-called "Euro-2" and "Euro-3" respectively) and beyond, for petrol (gasoline) and diesel fuel, 2006.

Lewis. Sr.. Richard J.: Hawley's Condensed Chemical Dictionary, 14th Ed.. John Wiley & Sons. New York. 2001 (p. 228).

Ballard. D. H., Generalizing the Hough Transformation to Detect Arbitrary Shapes. Pattern Recognition. vol. 13. No. 2. pp. 111-122. 1981.

Z. Liang & C. S. Hsu, "Molecular Speciation of Saturates by On-Line Liquid Chromatography-Field Ionization Mass Spectrometry", Energy & Fuel. Apr. 1998.

R.M. Mortier & S.T. Orszulik. "Chemistry and Technology of Lubricants". 2nd Ed.. pp. 4-5. 1997.

Lucie Coniglio and Armelle Nouviaire "A Method for Estimating the Normal Boiling Point of Heavy Hydrocarbons Suitable for a Group-Contribution-Based Equation of State", published in 2001 by the American Chemical Society. Incl. Eng. Chem. Res. 2001. 40. 1781-1790.

G. Klesper and F.W. Röllgen, "Field-Induced Ion Chemistry Leading to the Formation of $(M-2nH)^+$ and $(2M-2mH)^+$ Ions in Field Desorption Mass Spectrometry of Saturated Hydrocarbons," *Journal of Mass Spectrometry*, vol. 31, 383-388 (1996).

L. Montanari et al., NMR Molecular Characterization of Lubricating Base Oils: Correlation With Their Performance, Applied Magnetic Resonance, vol. 14 (1998) pp. 345-356.

Amarjeet S. Sarpal et al., "Characterization by $^{13}C$ n.m.r. spectroscopy of base oils produced by different processes," *Fuel* vol. 76, No. 10 (1997) pp. 931-937.

Nicholas P. Cheremisinoff, Ph.D., Polymer Characterization Laboratory Techniques and Analysis, 1996, p. 187.

D. Klamman, Lubricants and Related Products, 1984, vol. 9, Additives.

W.M. Meier and D.H. Olson, "Atlas of Zeolite Structure Types," Second Revised Edition, Butterworths, 1987 pp. 64, 65, 100, 101.

* cited by examiner

LUBRICANT COMPOSITION HAVING A BASE OIL AND ONE OR MORE ADDITIVES, WHEREIN THE BASE OIL HAS BEEN OBTAINED FROM WAXY PARAFFINIC FISCHER-TROPSCH SYNTHESIZED HYDROCARBONS

FIELD OF THE INVENTION

The invention is directed to a lubricant composition comprising a base oil and one or more additives wherein the lubricant composition has a kinematic viscosity at 100° C. of more than 5.6 cSt, a cold cranking simulated dynamic viscosity at −35° C. according to ASTM D 5293 of less than 6200 centiPoise (cP) and a mini rotary viscosity test value of less than 60000 cP according to ASTM D 4684.

BACKGROUND OF THE INVENTION

Such lubricant compositions are also referred to as SAE 0W-x compositions. SAE stands for Society of Automotive Engineers in the USA. The "0" number in such a designation is associated with a maximum viscosity requirement at −35° C. for that composition as measured typically by a cold cranking simulator (VdCCS) under high shear. The second number "x" is associated with a kinematic viscosity requirement at 100° C.

The minimum high temperature viscosity requirement at 100° C. is intended to prevent the oil from thinning out too much during engine operation which can lead to excessive wear and increased oil consumption. The maximum low temperature viscosity requirement, VdCCS, is intended to facilitate engine starting or cranking in cold weather. To ensure pumpability the cold oil should readily flow or slump into the well for the oil pump, otherwise the engine can be damaged due to insufficient lubrication. The mini rotary viscosity (MRV) requirement is intended to ensure a minimum pumpability performance.

U.S. Pat. No. 5,693,598 describes a lubricant formulation according to 0W-20 based on so-called poly-alpha olefins. Poly-alpha olefins are prepared by oligermization of alpha olefins (PAO) as for example described in U.S. Pat. No. 3,965,018. The disadvantage of such PAO base stock is its high cost of manufacture, as for example mentioned in the introductory part of U.S. Pat. No. 6,060,437. Nevertheless PAO are widely used to formulate such lubricant compositions because no commercially available alternative exists having the cleanliness and low temperature properties as PAO. Another aspect of using PAO base stock is that additional base stock like for example ester based or aromatic based base stock will also be present in the lubricant formulation in order to confer additional desired characteristics as for example additive solvency and seal compatibility.

SUMMARY OF THE INVENTION

The object of the present invention is to provide an alternative for PAO base stocks in 0W-x compositions. This object is achieved with the following composition. A lubricant composition comprising a base oil and one or more additives wherein the lubricant composition has a kinematic viscosity at 100° C. of more than 5.6 cSt, a cold cranking simulated dynamic viscosity at −35° C. according to ASTM D 5293 of less than 6200 centiPoise (cP) and a mini rotary viscosity test value of less than 60000 cP according to ASTM D 4684, wherein the base oil has been obtained from waxy paraffinic Fischer-Tropsch synthesized hydrocarbons.

DETAILED DESCRIPTION OF THE INVENTION

Figure 1:
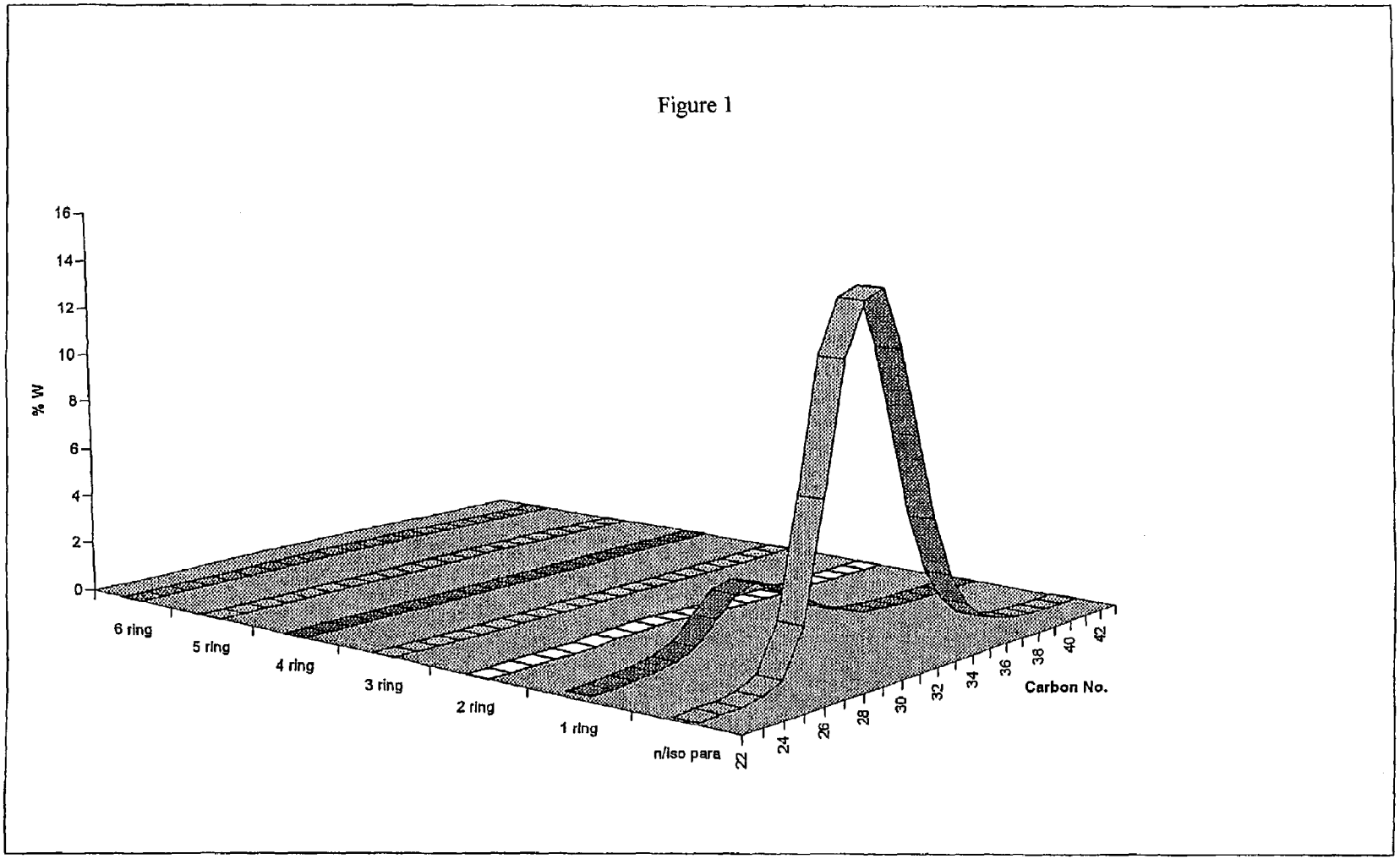
FIG. 1 shows the content of the normal and iso-paraffins, 1-ring cyclo-paraffins, 2-ring cyclo-paraffins, etc. in the saturates phase as a function of their respective carbon numbers of the base oil of Example 5.

It has been found that lubricants based on base oils obtainable from a waxy paraffinic Fischer-Tropsch product can be obtained having the desired properties of an SAE 0W-x formulation.

The base oil to be used in the lubricant composition according to the invention is obtained from Fischer-Tropsch synthesized hydrocarbons. Processes to prepare the base oils from such a feedstock are described in for example EP-A-776959, EP-A-668342, U.S. Pat. No. 4,943,672, U.S. Pat. No. 5,059,299 and WO-A-9920720. The process will generally comprise a Fischer-Tropsch synthesis, a hydroisomerization step and a pour point reducing step, wherein said hydroisomerization step and pour point reducing step are performed as:

(a) hydrocracking/hydroisomerizating a Fischer-Tropsch product;

(b) separating the product of step (a) into at least one or more fuel fractions and a base oil precursor fraction; and (c) performing a pour point reducing step to the base oil precursor fraction obtained in step (b).

Examples of Fischer-Tropsch synthesis processes steps to prepare said Fischer-Tropsch product and hydroisomerization steps (a) are known from the so-called commercial Sasol process, the commercial Shell Middle Distillate Process or the non-commercial Exxon process.

The Fischer-Tropsch product used in step (a) will contain no or very little sulphur and nitrogen containing compounds. This is typical for a product derived from a Fischer-Tropsch reaction which uses synthesis gas containing almost no such impurities. Sulphur and nitrogen levels will generally be below the detection limit, which is currently 1 ppm for nitrogen and 5 ppm for sulphur.

The Fischer-Tropsch product may optionally be subjected to a mild hydrotreatment step in order to remove any oxygenates and saturate any olefinic compounds present in the reaction product of the Fischer-Tropsch reaction. Such a hydrotreatment is described in EP-B-668342. The mildness of the hydrotreating step is preferably expressed in that the degree of conversion in this step is less than 20 wt % and more preferably less than 10 wt %. The conversion is here defined as the weight percentage of the feed boiling above 370° C., which reacts to a fraction boiling below 370° C.

Preferably any compounds having 4 or less carbon atoms and any compounds having a boiling point in that range are separated from a Fischer-Tropsch synthesis product before being used in step (a). The Fischer-Tropsch product may optionally be separated into a fraction boiling substantially below 370° C. and a fraction boiling substantially above 370° C. wherein the heavier fraction is used as feed to step (a). An example of such a process line-up is disclosed in WO-A-0014179.

The Fischer-Tropsch product as described in detail above is a Fischer-Tropsch product, which has not been subjected to any hydroconversion step apart from an optional mild hydrotreating step. The content of non-branched compounds in the Fischer-Tropsch product will therefore be above 80 wt %. In addition to the Fischer-Tropsch product also other fractions may be additionally processed in step (a). Possible other fractions may suitably be the higher boiling fraction obtained in step (b) or part of said fraction and/or off-spec base oil fractions as obtained in step (c).

The hydrocracking/hydroisomerization reaction of step (a) is preferably performed in the presence of hydrogen and a catalyst, which catalyst can be chosen from those known to one skilled in the art as being suitable for this reaction. Catalysts for use in step (a) typically comprise an acidic functionality and a hydrogenation/dehydrogenation functionality. Preferred acidic functionalities are refractory metal oxide carriers. Suitable carrier materials include silica, alumina, silica-alumina, zirconia, titania and mixtures thereof. Preferred carrier materials for inclusion in the catalyst for use in the process of this invention are silica, alumina and silica-alumina. A particularly preferred catalyst comprises platinum supported on a silica-alumina carrier. If desired, applying a halogen moiety, in particular fluorine, or a phosphorous moiety to the carrier, may enhance the acidity of the catalyst carrier. Examples of suitable hydrocracking/hydroisomerization-processes and suitable catalysts are described in WO-A-0014179, EP-A-532118, EP-A-666894 and the earlier referred to EP-A-77695.

Preferred hydrogenation/dehydrogenation functionalities are Group VIII noble metals, for example palladium and more preferably platinum. The catalyst may comprise the hydrogenation/dehydrogenation active component in an amount of from 0.005 to 5 parts by weight, preferably from 0.02 to 2 parts by weight, per 100 parts by weight of carrier material. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder can be non-acidic. Examples are clays and other binders known to one skilled in the art.

In step (a) the feed is contacted with hydrogen in the presence of the catalyst at elevated temperature and pressure. The temperatures typically will be in the range of from 175 to 380° C., preferably higher than 250° C. and more preferably from 300 to 370° C. The pressure will typically be in the range of from 10 to 250 bar and preferably between 20 and 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg.

The conversion in step (a) as defined as the weight percentage of the feed boiling above 370° C. which reacts per pass to a fraction boiling below 370° C., is at least 20 wt %, preferably at least 25 wt %, but preferably not more than 80 wt %, more preferably not more than 65 wt %. The feed as used above in the definition is the total hydrocarbon feed fed to step (a), thus also including any optional recycle of the higher boiling fraction as obtained in step (b).

In step (b) the product of step (a) is preferably separated into one or more fuel fractions, a base oil precursor fraction having preferably a T10 wt % boiling point of between 200 and 450° C. and a T90 wt % boiling point of at least 300, preferably at least 400 and of at most 650 preferably at most 550° C., and a higher boiling fraction. By performing step (c) on the preferred narrow boiling base oil precursor fraction obtained in step (b) a haze free base oil grade can be obtained having also excellent other quality properties. The separation is preferably performed by means of a first distillation at about atmospheric conditions, preferably at a pressure of between 1.2-2 bara, wherein the fuel product, such as naphtha, kerosene and gas oil fractions, are separated from the higher boiling fraction of the product of step (a). The higher boiling fraction, of which suitably at least 95 wt % boils above 350° C., is subsequently further separated in a vacuum distillation step wherein a vacuum gas oil fraction, the base oil precursor fraction and the higher boiling fraction are obtained. The vacuum distillation is suitably performed at a pressure of between 0.001 and 0.05 bara.

The vacuum distillation of step (b) is preferably operated such that the desired base oil precursor fraction is obtained boiling in the specified range and having a kinematic viscosity, which relates to the base oil end product(s) specification. The kinematic viscosity at 100° C. of the base oil precursor fraction is preferably between 3 and 10 cst.

Suitably the above described waxy paraffinic product or base oil precursor fraction is obtained in the hydroisomerisation process step wherein the content on non-cyclic iso-paraffin compounds, relative to the total of non-cyclic iso- and normal paraffins, is increased to above 90 wt %. This waxy paraffinic product, which boils for the greater part above 370° C., is subsequently subjected to a pour point reducing step. The pour point reducing step can be by means of solvent dewaxing or catalytic dewaxing according to the aforementioned publications. The dewaxed product is further purified in order to remove both a light and optionally a heavy fraction, such to obtain the base oil suitable for use in the lubricant formulation of the present invention.

Preferably the base oil is prepared by a process wherein the pour point reducing step is performed by means of a catalytic dewaxing. With such a process it has been found that base oils have a sufficiently low pour point of, for example as low as −40° C. The catalytic dewaxing process can be performed by any process wherein in the presence of a catalyst and hydrogen the pour point of the base oil precursor fraction is reduced as specified above. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point of the base oil precursor fraction under catalytic dewaxing conditions. Preferably the intermediate pore size zeolites have a pore diameter of between 0.35 and 0.8 nm. Suitable intermediate pore size zeolites are mordenite, ZSM-5, ZSM-12, ZSM-22, ZSM-23, SSZ-32, ZSM-35 and ZSM-48. Another preferred group of molecular sieves are the silica-aluminaphosphate (SAPO) materials of which SAPO-11 is most preferred as for example described in U.S. Pat. No. 4,859,311. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Pt/ZSM-35, Ni/ZSM-5, Pt/ZSM-23, Pd/ZSM-23, Pt/ZSM-48 and Pt/SAPO-11. Further details and examples of suitable molecular sieves and dewaxing conditions are for example described in WO-A-9718278, U.S. Pat. No. 4,343,692, U.S. Pat. No. 5,053,373, WO-A-0014184, U.S. Pat. No. 5,252,527 and U.S. Pat. No. 4,574,043.

The dewaxing catalyst suitably also comprises a binder. The binder can be a synthetic or naturally occurring (inorganic) substance, for example clay, silica and/or metal oxides. Natural occurring clays are for example of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material, which is essentially free of alumina, is used. Examples of these binder materials are silica, zirconia, titanium dioxide, germanium dioxide, boria and mixtures of two or more of these of which examples are listed above. The most preferred binder is silica.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment is by contacting an extrudate of the binder and the zeolite with an aqueous solution of a fluorosilicate salt as described in for example U.S. Pat. No. 5,157,191 or WO-A-0029511. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22, as for example described in WO-A-0029511 and EP-B-832171.

Catalytic dewaxing conditions are known in the art and typically involve operating temperatures in the range of from 200 to 500° C., suitably from 250 to 400° C., hydrogen pressures in the range of from 10 to 200 bar, preferably from 40 to 70 bar, weight hourly space velocities (WHSV) in the range of from 0.1 to 10 kg of oil per liter of catalyst per hour (kg/l/hr), suitably from 0.2 to 5 kg/l/hr, more suitably from 0.5 to 3 kg/l/hr and hydrogen to oil ratios in the range of from 100 to 2,000 liters of hydrogen per liter of oil. By varying the temperature between 275° C., suitably between 315° C. and 375° C. at between 40-70 bars, in the catalytic dewaxing step it is possible to prepare base oils having different pour point specifications varying from suitably −10 to −60° C.

The lubricant composition suitably comprises between 65 and 85 wt % of the Fischer-Tropsch derived base oil. The remaining part of the composition consists of one or more additives. Optionally part of the lubricant composition may comprise of a second base oil, for example PAO, petroleum derived based base oil or esters. This fraction will suitably be less than 10 wt %. The advantages of the invention are however fully appreciated when only the Fischer-Tropsch derived base oil are used as base oil according to the present invention.

Applicants have found that when a special novel class of base oils, as obtainable from waxy paraffinic Fischer-Tropsch synthesized hydrocarbons, is used to formulate the lubricant composition no or much less additional base stock is needed. This base oil composition preferably comprises preferably at least 98 wt % saturates, more preferably at least 99.5 wt % saturates and most preferably at least 99.9 wt %. This saturates fraction in the base oil comprises between 10 and 40 wt % of cyclo-paraffins. Preferably the content of cyclo-paraffins is less than 30 wt % and more preferably less than 20 wt %. Preferably the content of cyclo-paraffins is at least 12 wt % and more preferably at least 15 wt %. The unique and novel base oils are further characterized in that the weight ratio of 1-ring cyclo-paraffins relative to cyclo-paraffins having two or more rings is greater than 3 preferably greater than 5. It was found that this ratio is suitably smaller than 15.

The cyclo-paraffin content as described above is measured by the following method. Any other method resulting in the same results may also be used. The base oil sample is first separated into a polar (aromatic) phase and a non-polar (saturates) phase by making use of a high performance liquid chromatography (HPLC) method IP368/01, wherein as mobile phase pentane is used instead of hexane as the method states. The saturates and aromatic fractions are then analyzed using a Finnigan MAT90 mass spectrometer equipped with a Field desorption/Field Ionisation (FD/FI) interface, wherein FI (a "soft" ionisation technique) is used for the semi-quantitative determination of hydrocarbon types in terms of carbon number and hydrogen deficiency. The type classification of compounds in mass spectrometry is determined by the characteristic ions formed and is normally classified by "z number". This is given by the general formula for all hydrocarbon species: $CnH_2n+z$. Because the saturates phase is analysed separately from the aromatic phase it is possible to determine the content of the different (cyclo)-paraffins having the same stoichiometry. The results of the mass spectrometer are processed using commercial software (poly 32; available from Sierra Analytics LLC, 3453 Dragoo Park Drive, Modesto, Calif. GA95350 USA) to determine the relative proportions of each hydrocarbon type and the average molecular weight and polydispersity of the saturates and aromatics fractions.

The base oil composition preferably has a content of aromatic hydrocarbon compounds of less than 1 wt %, more preferably less than 0.5 wt % and most preferably less 0.1 wt %, a sulphur content of less than 20 ppm and a nitrogen content of less than 20 ppm. The pour point of the base oil is preferably less than −30° C. and more preferably lower than −40° C. The viscosity index is preferably higher than 120. It has been found that the novel base oils typically have a viscosity index of below 140. The kinematic viscosity at 100° C. of the base oil is preferably between 4.0 and 8 cSt and the Noack volatility is preferably lower than 14 wt %.

The above base oil is believed to be novel. Relevant publications like WO-A-0014188, WO-A-14187 and WO-A-0014179 disclose base oils derived from a Fischer-Tropsch synthesis product containing more than 95 wt % iso-paraffins. WO-A-0118156 describes a base oil derived from a Fischer-Tropsch product having a naphthenics content of less than 10%. Also the base oils as disclosed in applicant's patent applications EP-A-776959 or EP-A-668342 have been found to comprise less than 10 wt % of cyclo-paraffins. Applicants repeated Example 2 and 3 of EP-A-776959 and base oils were obtained, from a waxy Fischer-Tropsch synthesis product, wherein the base oils consisted of respectively about 96 wt % and 93 wt % of iso-paraffins and any n-paraffins. Applicants further prepared a base oil having a pour point of −21° C. by catalytic dewaxing a Shell MDS Waxy Raffinate using a catalyst comprising synthetic ferrierite and platinum according to the teaching of EP-A-668342 and found that the content of iso- and normal paraffins was about 94 wt %. Thus these prior art base oils derived from a Fischer-Tropsch synthesis product had at least a cyclo-paraffin content of below 10 wt %. Furthermore the base oils as disclosed by the examples of application WO-A-9920720 will not comprise a high cyclo-paraffin content. This because feedstock and preparation used in said examples is very similar to the feedstock and preparation to prepare the above prior art samples based on EP-A-776959 and EP-A-668342.

Applicants found that the base oil, having the higher cyclo-paraffin content as described above, is obtainable by the following process. This process is characterised in that the Fischer-Tropsch product used as feed to step (a) has a weight ratio of compounds having at least 60 or more carbon atoms and compounds having at least 30 carbon atoms in the Fischer-Tropsch product of at least 0.2 and wherein at least 30 wt % of compounds in the Fischer-Tropsch product have at least 30 carbon atoms. More preferably the Fischer-Tropsch product has at least 50 wt %, and more preferably at least 55 wt % of compounds having at least 30 carbon atoms. Furthermore the weight ratio of compounds having at least 60 or more carbon atoms and compounds having at least 30 carbon atoms of the Fischer-Tropsch product is at least 0.2, preferably at least 0.4 and more preferably at least 0.55. Preferably the Fischer-Tropsch product comprises a $C_{20}^{+}$ fraction having an ASF-alpha value (Anderson-Schulz-Flory chain growth factor) of at least 0.925, preferably at least 0.935, more preferably at least 0.945, even more preferably at least 0.955. The initial boiling point of the Fischer-Tropsch product may range up to 400° C., but is preferably below 200° C.

Such a Fischer-Tropsch product can be obtained by any process, which yields a relatively heavy Fischer-Tropsch product. Not all Fischer-Tropsch processes yield such a heavy product. Examples of suitable Fischer-Tropsch processes are described in WO-A-9934917 and in AU-A-698392. These processes may yield a Fischer-Tropsch product as described above.

The base oil as obtainable by the above processes has a pour point of less than −39° C. and a kinematic viscosity at 100° C. which is suitably between 4 and 8 cSt. The actual kinematic viscosity at 100° C. will depend on the specific 0W-x grade one wishes to prepare. For the 0W-20 and 0W-30 lubricant grades a base oil having a kinematic viscosity at 100° C. of between 3.8 and 5.5 cSt is suitably used. For an 0W-40 grade a base oil having a kinematic viscosity at 100° C. of between 5.5 and 8 cSt is suitably used.

The lubricant composition comprises one or more additives. Examples of additive types which may form part of the composition are dispersants, detergents, viscosity modifying polymers, extreme pressure/antiwear additives, antioxidants, pour point depressants, emulsifiers, demulsifiers, corrosion inhibitors, rust inhibitors, antistaining additives, friction modifiers. Specific examples of such additives are described in for example Kirk-Othmer Encyclopedia of Chemical Technology, third edition, volume 14, pages 477-526.

Suitably the anti-wear additive is a zinc dialkyl dithiophosphate. Suitably the dispersant is an ashless dispersant, for example polybutylene succinimide polyamines or Mannic base type dispersants. Suitably the detergent is an over-based metallic detergent, for example the phosphonate, sulfonate, phenolate or salicylate types as described in the above referred to General Textbook. Suitably the antioxidant is a hindered phenolic or aminic compound, for example alkylated or styrenated diphenylamines or ionol derived hindered phenols. Suitably the viscosity modifier is a viscosity modifying polymer, for example polyisobutylenes, olefin copolymers, polymethacrylates and polyalkylstyrenes and hydrogenated polyisoprene star polymer (Shellvis). Examples of suitable antifoaming agents are polydimethylsiloxanes and polyethylene glycol ethers and esters.

The lubricant formulation is preferably an 0W-x passenger car motor oil or 0W-x heavy duty diesel engine oil, wherein x is 20, 30 or 40.

The invention will be illustrated by means of the following non-limiting examples.

EXAMPLE 1

Example 1 illustrates the process to prepare a base oil having a higher cyclo-paraffin content.

A Fischer-Tropsch product was made having boiling curve as in Table 1 by repeating Example VII of WO-A-9934917 using the catalyst as prepared in Example III of the same publication and subsequently removing the $C_4$ and lower boiling compounds from the effluent of the synthesis reaction. The feed contained about 60 wt % $C_{30}$+ product. The ratio $C_{60}$+/$C_{30}$+ was about 0.55.

TABLE 1

| Recovered (wt %) | Temperature (° C.) |
|---|---|
| Initial boiling point | 82 |
| 10 | 249 |
| 30 | 424 |
| 50 | 553 |
| 70 | 671 |
| 90 | >750 |

The Fischer-Tropsch product as thus obtained was continuously fed to a hydrocracking step (step (a)). In the hydrocracking step the Fischer-Tropsch product and a recycle stream consisting of the 370° C.$^{+}$ fraction of the effluent of step (a) was contacted with a hydrocracking catalyst of Example 1 of EP-A-532118 at a reactor temperature of 330° C. The Fischer-Tropsch product WHSV was contacted at 0.8 kg/l.h and the recycle stream was rate was 0.2 kg/l.h at a total pressure of 35 bar and a hydrogen partial pressure of 33 bar. The recycle gas rate was 2000 Nl/kg of total feed. The conversion of compounds boiling above 370° C. in the total feed which were converted to products boiling below 370° C. was 55 wt %. The product of the hydrocracking step was distilled into one or more fuels fractions boiling in the naptha, kerosene and gas oil range and a bottom product boiling about 370° C.

The 370° C$^{+}$ fraction thus obtained was in turn distilled in a vacuum distillation column, wherein the feed rate to the column was 750 g/h, the pressure at the top was kept at 0.4 mm Hg (0.5 mbar) and the temperature at the top was kept at 240° C., which is equal to an atmospheric cut off temperature of 515° C. The top product had thus a boiling range of between 370 and 515° C. Further properties were a pour point of +18° C. and a kinematic viscosity at 100° C. of 3.8 cSt. This top product was further used as the base oil precursor fraction in step (c).

In the dewaxing step (c) the base oil precursor fraction was contacted with a dealuminated silica bound ZSM-5 catalyst comprising 0.7% by weight Pt and 30 wt % ZSM-5 as described in Example 9 of WO-A-0029511. The dewaxing conditions were: total pressure 40 bar, a hydrogen partial pressure at the reactor outlet of 36 bar, WHSV=1 kg/l.h, a temperature of 340° C. and a recycle gas rate of 500 Nl/kg feed.

The dewaxed oil was distilled, wherein a lighter and a heavier fraction was removed to obtain the final base oil having properties as listed in Table 2.

TABLE 2

| | |
|---|---|
| Density d20/4 | 814 |
| Mean boiling point (50 wt % recovered) | 430° C. |
| Kinematic viscosity at 40° C. | 18 cSt |
| Kinematic viscosity at 100° C. | 4.0 cSt |
| Viscosity index | 121 |
| Pour point | −50° C. |
| Noack volatility | 11 wt % |

EXAMPLE 2

Example 1 was repeated except that the dewaxed oil was distilled differently to yield the base oil having properties as listed in Table 3.

TABLE 3

| | |
|---|---|
| Density d20/4 | 818 |
| Mean boiling point (50 wt % recovered) | 448° C. |
| Kinematic viscosity at 40° C. | 23.4 cSt |
| Kinematic viscosity at 100° C. | 4.9 cSt |
| Viscosity index | 128 |
| Pour point | −55° C. |
| Noack volatility | 6.8 wt % |

EXAMPLE 3

74.6 weight parts of a base oil, having the properties as listed in Table 4 and which was obtained by catalytic dewaxing of a hydroisomerised/hydrocracked Fischer-Tropsch product as illustrated by Examples 1 and 2, was blended with 14.6 weight parts of a standard detergent inhibitor additive package, 0.25 weight parts of a corrosion inhibitor and 10.56 weight parts of a viscosity modifier. The properties of the resulting composition are listed in Table 5. Table 5 also shows the 0W-30 specifications for motor gasoline lubricants. It is clear that the composition as obtained in this Example meets the requirements of an 0W30 motor gasoline specification.

COMPARATIVE EXPERIMENT A 54.65 weight parts of a poly-alpha olefin-4 (PAO-4) and 19.94 weight parts of a poly-alpha olefin-5 (PAO-5), having the properties as listed in Table 1 were blended with the same quantity and quality of additives as in Example 3. The properties of the resulting composition are listed in Table 5. This experiment and Example 3 shows that a base oil as obtained by the present invention can be successfully used to formulate 0W-30 motor gasoline lubricants using the same additives as used to formulate such a grade based on poly-alpha olefins.

TABLE 4

| | PAO-4 | PAO-5 | Base oil of Example 3 |
|---|---|---|---|
| kinematic viscosity at 100° C. (1) | 3.934 | 5.149 | 4.234 |
| kinematic viscosity at 40° C. (2) | 17.53 | 24.31 | 19.35 |
| viscosity index (3) | 121 | 148 | 125 |
| VDCCS @ −35° C. (P) (4) | 13.63 | 23.08 | 21.17 |
| VDCCS @ −30° C. (P) (5) | 10.3 | 16 | 14.1 |
| MRV cP @ −40° C. (6) | 2350 | 4070 | 3786 |
| Pour Point ° C. (7) | less than −66 | −45 | −45 |
| Noack (wt %) (8) | 13.4 | 6.6 | 10.6 |

TABLE 4-continued

| | PAO-4 | PAO-5 | Base oil of Example 3 |
|---|---|---|---|
| Content(**) 1-ring cyclo-paraffins (wt %) | n.a. (*) | n.a. | 13 wt % |
| content 2-ring cyclo-paraffins (wt %) | n.a. | n.a. | 1 wt % |
| Content of 3 and higher ring cyclo-paraffins | n.a. | n.a. | <0.1 wt % |

(*) Not analysed but presumed to be zero due to the manner in which poly-alpha olefins are prepared.
(**) Content as based on the whole base oil composition (1) Kinematic viscosity at 100° C. as determined by ASTM D 445, (2) Kinematic viscosity at 40° C. as determined by ASTM D 445, (3) Viscosity Index as determined by ASTM D 2270, (4) VDCCS @−35° C. (P) stands for dynamic viscosity at −35 degrees Centigrade and is measured according to ASTM D 5293, (5) VDCCS @−35° C. (P) stands for dynamic viscosity at −35 degrees Centigrade and is measured according to ASTM D 5293, (6) MRV cP @−40° C. stands for mini rotary viscometer test and is measured according to ASTM D 4684, (7) pour point according to ASTM D 97, (8) Noack volatility as determined by ASTM D 5800.

TABLE 5

| | 0W-30 specifications | Example 3 | Comparative experiment A |
|---|---|---|---|
| kinematic viscosity at 100° C. (cSt) | 9.3-12.5 | 9.69 | 9.77 |
| VDCCS P @ −35° C. | 62.0 max | 61.2 | 48.3 |
| MRV cP @ −40° C. (cP) | 60000 max | 17500 | 12900 |
| Yield stress | No | No | No |
| Pour Point (° C.) | — | −60 | −60 |
| Noack (wt %) | — | 11.7 | 11.2 |

EXAMPLE 4-5

Base oils as prepared from the same feed as in Examples 1 and 2 under varying conditions were prepared. Properties are listed in Table 6. The cyclo-paraffins and normal and iso-paraffins of the base oil of Example 5 (see Table 6) were further analysed. In FIG. 1 the content of the components, normal and iso-paraffins, 1-ring cyclo-paraffins, 2-ring cyclo-paraffins, etc. in the saturates phase as a function of their respective carbon numbers are shown of the base oil of Example 5.

TABLE 6

| Base oil type | Example 4 | Example 5 | Base oil as obtained in Example 2 of EP-A-776959 | Base oil as obtained by catalytic dewaxing a Shell MDS Waxy Raffinate over a Pt/synthetic ferrierite catalyst (*) | Base oil as obtained by catalytic dewaxing a Shell MDS Waxy Raffinate over a Pt/synthetic ferrierite catalyst (**) |
|---|---|---|---|---|---|
| Viscosity Index | 127 | 121 | 151 | 138 | 132 |
| Pour point (° C.) | −48 | −54 | −19 | −21 | −39 |
| Kinematic viscosity at 100° C. (cSt) | 4.77 | 4.14 | 4.80 | 4.91 | 4.96 |

TABLE 6-continued

| Base oil type | Example 4 | Example 5 | Base oil as obtained in Example 2 of EP-A-776959 | Base oil as obtained by catalytic dewaxing a Shell MDS Waxy Raffinate over a Pt/synthetic ferrierite catalyst (*) | Base oil as obtained by catalytic dewaxing a Shell MDS Waxy Raffinate over a Pt/synthetic ferrierite catalyst (**) |
|---|---|---|---|---|---|
| Dynamic viscosity as measured by CCS at −40° C. (cP) | 5500 | 3900 | 6800 | 5300 cP | 5700 cP |
| Saturates content (wt %) | 99.1 | 99.9 | 99.8 | 99.7 | 99.6 |
| Total cyolo-paraffin content | 13.7 | 18.5 | 4.1 | 6.1 | 8.2 |
| 1-ring cyclo-paraffins (wt %) | 11.1 | 16.8 | 3.7 | 4.9 | 6.4 |
| 2-ring cyclo-paraffins | 1.4 | 1.4 | 0.2 | 0.5 | 0.7 |
| 3 and higher number rings cyclo-paraffins | 1.2 | 0.3 | 0.2 | 0.7 | 1.1 |

(*) Reaction conditions: total pressure 40 bars, WHSV = 1 kg/l/h, gas recycle rate = 700 Nl/kg feed and temperature of 290° C..
(**) as in (*) but at 320° C. dewaxing temperature.

We claim:

1. A lubricant composition comprising a base oil and one or more additives wherein the lubricant composition has a kinematic viscosity at 100° C. of more than 5.6 cSt, a cold cranking simulated dynamic viscosity at −35° C. according to ASTM D 5293 of less than 6200 centiPoise (cP) and a mini rotary viscosity test value of less than 60000 cP according to ASTM D 4684, wherein the base oil has been obtained from waxy paraffinic Fischer-Tropsch synthesized hydrocarbons, the base oil comprising at least 98 wt % saturates, the saturates comprising between 10 and 40 wt % cyclo-paraffins comprising a weight ratio of greater than 3 of 1-ring cyclo-paraffins relative to cyclo-paraffins having two or more rings.

2. The lubricant composition of claim 1, wherein the base oil has a pour point of less than −39° C. and a kinematic viscosity at 100° of between 3.8 cSt and 5.5 cSt and the lubricant composition has a kinematic viscosity at 100° C. of between 9.3 cSt and 12.5 cSt.

3. The lubricant composition of claim 1, wherein the lubricant composition comprises less than 10 wt % of an additional base oil.

4. The lubricant composition of claim 3, wherein the lubricant composition comprises no additional base oil.

5. The lubricant composition of claim 1, wherein the saturates comprise between 12 wt % and 40 wt % of cyclo-paraffins.

6. The lubricant composition of claim 1, wherein the weight ratio of 1-ring cyclo-paraffins relative to cyclo-paraffins having two or more rings is less than 15.

7. The lubricant composition of claim 1 comprising a motor oil having a grade of 0W-x, wherein x is 20, 30 or 40.

8. The lubricant composition of claim 1 wherein the base oil comprises:

less than 1 wt. % aromatic hydrocarbon compounds;
less than 20 ppm sulfur; and,
less than 20 ppm nitrogen.

9. The lubricant composition of claim 8 wherein the base oil comprises less than 0.5 wt. % aromatic hydrocarbon compounds.

10. The lubricant composition of claim 8 wherein the base oil comprises less than 0.1 wt. % aromatic hydrocarbon compounds.

11. A passenger car motor oil comprising a base oil and one or more additives wherein the motor oil composition has a kinematic viscosity at 100° C. of more than 5.6 cSt, a cold cranking simulated dynamic viscosity at −35° C. according to ASTM D 5293 of less than 6200 centiPoise (cP) and a mini rotary viscosity test value of less than 60000 cP according to ASTM D 4684, wherein the base oil has been obtained from waxy paraffinic Fischer-Tropsch synthesized hydrocarbons, wherein said motor oil has a grade of 0W-X, wherein X is 20, 30 or 40, the base oil comprising primarily saturates, the saturates comprising between 10 and 40 wt. % cyclo-paraffins comprising a weight ratio of greater than 3 of 1-ring cyclo-paraffins relative to cyclo-paraffins having two or more rings.

12. A heavy duty diesel engine oil comprising a base oil and one or more additives wherein the diesel engine oil composition has a kinematic viscosity at 100° C. of more than 5.6 cSt, a cold cranking simulated dynamic viscosity at −35° C. according to ASTM D 5293 of less than 6200 centiPoise (cP) and a mini rotary viscosity test value of less than 60000 cP according to ASTM D 4684, wherein the base oil has been obtained from waxy paraffinic Fischer-Tropsch synthesized hydrocarbons, wherein said motor oil has a grade of 0W-X, wherein X is 20, 30 or 40, the base oil comprising primarily saturates, the saturates comprising between 10 and 40 wt. % cyclo-paraffins comprising a weight ratio of greater than 3 of 1-ring cyclo-paraffins relative to cyclo-paraffins having two or more rings.

* * * * *